United States Patent [19]

Morris

[11] Patent Number: 4,480,241

[45] Date of Patent: Oct. 30, 1984

[54] DISCRIMINATOR DEVICE

[75] Inventor: Raymond T. Morris, Gateshead, England

[73] Assignee: Northern Engineering Industries plc, England

[21] Appl. No.: 465,154

[22] Filed: Feb. 9, 1983

[30] Foreign Application Priority Data

Feb. 20, 1982 [GB] United Kingdom ..... 8205082

[51] Int. Cl.[3] ..... H01H 71/04

[52] U.S. Cl. ..... 335/17; 335/276; 340/815.24; 340/815.26

[58] Field of Search ..... 335/17, 272, 276; 340/373, 815.24, 815.26

[56] References Cited

U.S. PATENT DOCUMENTS 3,307,122 2/1967 Ellenberger ..... 335/17

4,124,831 11/1978 Kasahara ..... 335/17

*Primary Examiner*—George Harris

[57] ABSTRACT

A device discrimates between relatively shorter and relatively longer intervals by means of an interceptor member which:

(a) if an interval between a displacement thereof away from and a displacement thereof towards an intercept station is less than a predetermined interval, intercepts a rotor at a first position; or (b) if said interval is greater than said predetermined interval, does not intercept the rotor which can then move to a second position.

The member is movable by an electromagnetic mechanism, e.g. a coil and armature arrangement.

Displacement of the member away from the station propels the rotor towards a stop. After striking the stop, the rotor returns towards the first position and, if not intercepted thereat, moves on to said second position.

The device shown has a flag on the rotor for providing an indication of, e.g., operation. However, the device could be a relay, for example, instead of an indicator.

6 Claims, 4 Drawing Figures

DISCRIMINATOR DEVICE

BRIEF SUMMARY OF THE INVENTION

The invention relates to discriminator devices.

According to the invention, a discriminator device comprises a support structure, stop means mounted on said structure, means on said structure defining a pivot axis, a rotor mounted on said structure and angularly displaceable about said pivot axis to positions including first and second positions, said first position being intermediate said stop means and said second position, an electromagnetic mechanism mounted on said structure and an interceptor member carried by said structure and displaceable relatively thereto in first and second senses respectively towards and away from a station in which said interceptor member is normally engaged by said rotor in said first position, displacement of said interceptor member in said second sense propelling said rotor towards said stop means, an interval less than a predetermined value between a displacement of said interceptor member in said second sense and a displacement in said first sense allowing said interceptor member to return to said station early enough to intercept said rotor at said first position after said rotor has struck said stop means and in the return motion of said rotor therefrom, but a longer interval causing said interceptor member to be too late to intercept said rotor which continues in its return motion beyond said first position to reach said second position and said mechanism being operable to displace said interceptor member in at least one of said first and second senses.

BRIEF DESCRIPTION OF THE DRAWINGS

A discriminator device in the form of an indicator device will now be described to illustrate the invention by way of example only with reference to the accompanying drawings, in which.

DESCRIPTION OF THE INVENTION

Figure 1:
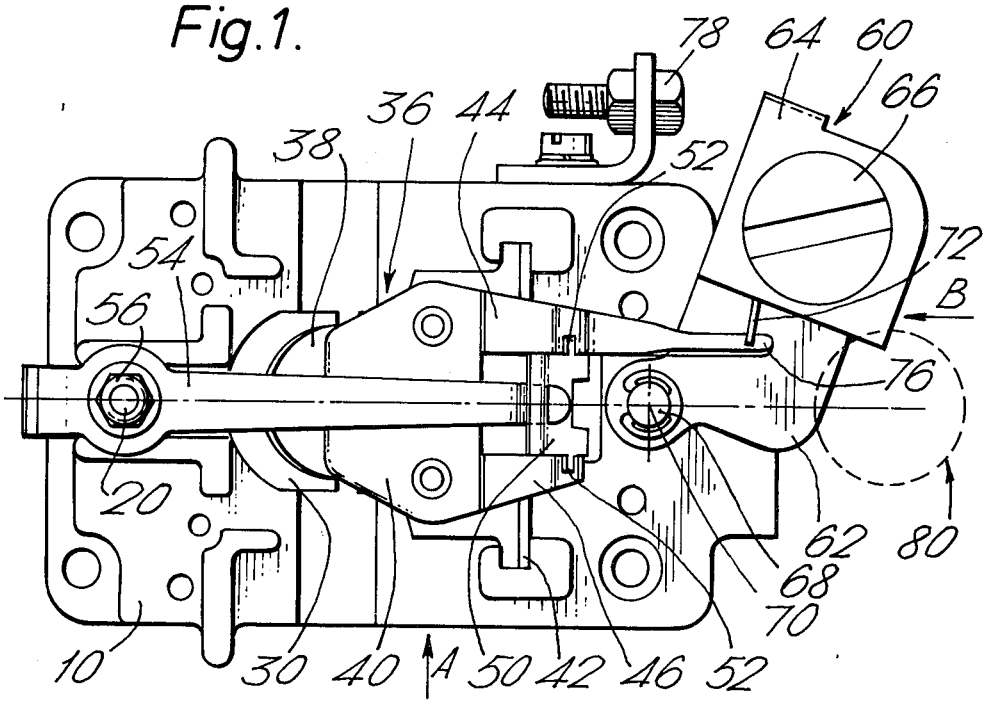
FIG. 1 is a diagrammatic side elevation of the device.

The indicator device has a support structure in the form of a base 10, for example a moulding of plastics material, on which other components are mounted.

The device has an L-shaped yoke 12. The end of the limb 14 of the yoke 12 fits into a slot in, and has wings 16 for locating the limb 14 relative to, the base member 10. The yoke 12 is secured to the base 10 by two screws 17 passing through the base 10 and screwed into the limb 18 of the yoke 12. A screw 20 passes through the limb 18, through a spacer 22 and through the base 10 and is secured by a nut 24.

The limb 18 of the yoke 12 is secured to one end of a core 26 which is slotted at 28 and which extends parallel to the limb 14. A copper shading ring 30 is mounted at the other end of the core. A coil 32 is located around the core 26 and is trapped between the limb 18 and the base member 10. The coil has leads 34.

An armature assembly 36 is operable to complete the magnetic circuit formed by the yoke 12 and the core 26 upon energisation of the coil 32. The armature assembly 36 has a plate 38 and a member 40. The plate 38 is made of 50% nickel/iron alloy, for example, and has a knife-edge 42 on which it balances on the end of the limb 14 of the yoke 12 and about which it can pivot towards and away from the core 26.

The member 40 is made of phosphor bronze, for example, and is secured to the plate 38. The member 40 has two parallel inclined limbs 44 and 46 which are kinked to provide recesses 48, in which a small slotted plate 50 is located by means of the edges of integral lateral arms 52. The plate 50 protrudes through the gap between the limbs 44, 46 of the member 40 to be located laterally with respect to the limbs 44, 46. One limb 44 has an integral extension forming an interceptor member 76 described further below.

An armature control spring 54 is located on the base member 10 by the screw 20 and is retained relative thereto by the nut 24. A nut 56 on the end of the screw 20 loads the spring 54. The free end of the spring 54 is located in the slot in the plate 50 to press the arms 52 of the plate 50 into the recesses 48 and to bias the armature assembly 36 away from the core. The armature assembly 36, under the influence of the spring 54, normally engages a stop 58 secured on the base 10 by the screw 20 and the nut 24.

A rotor in the form of a flag assembly 60 is pivotally mounted on a horizontal pivot pin 68 carried by the base member 10. The flag assembly 60 consists of a U-shaped bracket 62 to the base of which is attached one limb of an L-shaped bracket 64. The free limb of the bracket 64 has an easily visible marking or flag 66. The pin 68 passes through the limbs of the bracket 62, so that the flag assembly 60 can rotate about the horizontal pivot axis 70.

Figure 4:
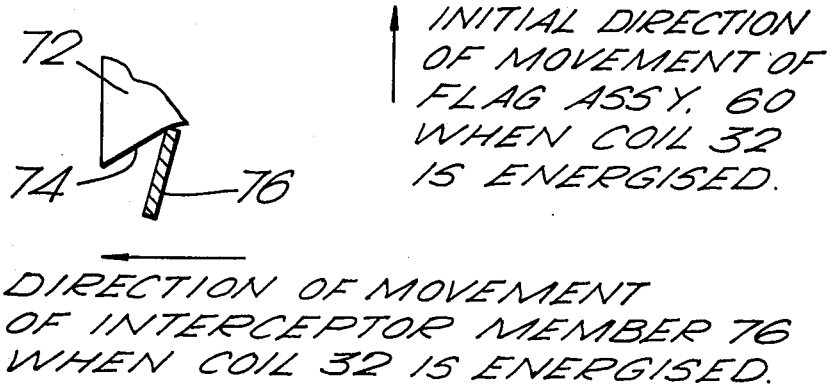
FIG. 4 is an enlarged view of the part encircled and labelled 'C' in FIG. 3.

The flag assembly 60 also includes an L-shaped plate 72. An edge of one limb of the plate 72 is secured to one limb of the bracket 62 to protrude normally to that limb. The lower edge of the free limb of the plate 72 provides a cam surface 74, which has its lowest point at a position remote from the bracket 62. The cam surface 74 engages the interceptor member 76 (see FIG. 4). Thus, the flag assembly 60 is supported in an upper non-indicating position (as shown in the drawings) by the interceptor member 76 until the device operates.

Upward movement of the flag assembly 60 about the axis 70, as explained below, is limited by an adjustable stop 78 mounted on the top of the base member 10.

OPERATION

When the coil 32 is energised, the armature assembly 36 is attracted to the core 26 in order to complete the magnetic circuit formed by the yoke 12 and the core 26. The armature assembly 36 moves rapidly anticlockwise (as seen in FIG. 2) and causes the interceptor member 76 to swing out of the plane of FIG. 1 to a position in which it is no longer beneath the plate 72 of the flag assembly 60. During such movement, the interceptor member 76 traverses the cam surface 74 and imparts sufficient upward acceleration to the plate 72 to cause the flag assembly 60 to swing upwardly about the axis 70 to hit the stop 78.

Figure 2:
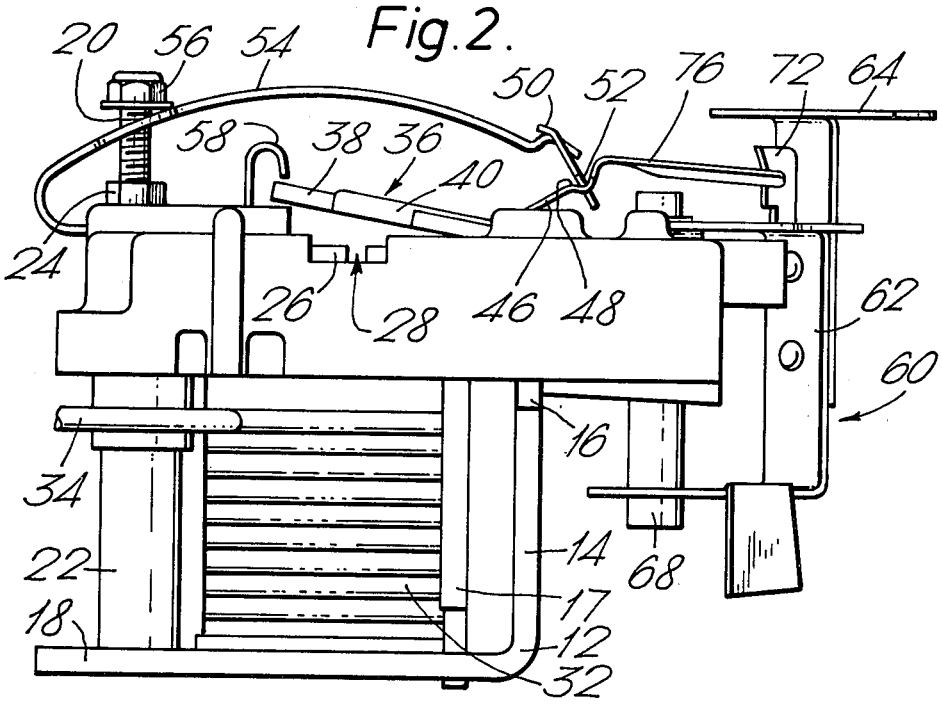
FIG. 2 is a view from beneath on arrow 'A' in FIG. 1.
Figure 3:
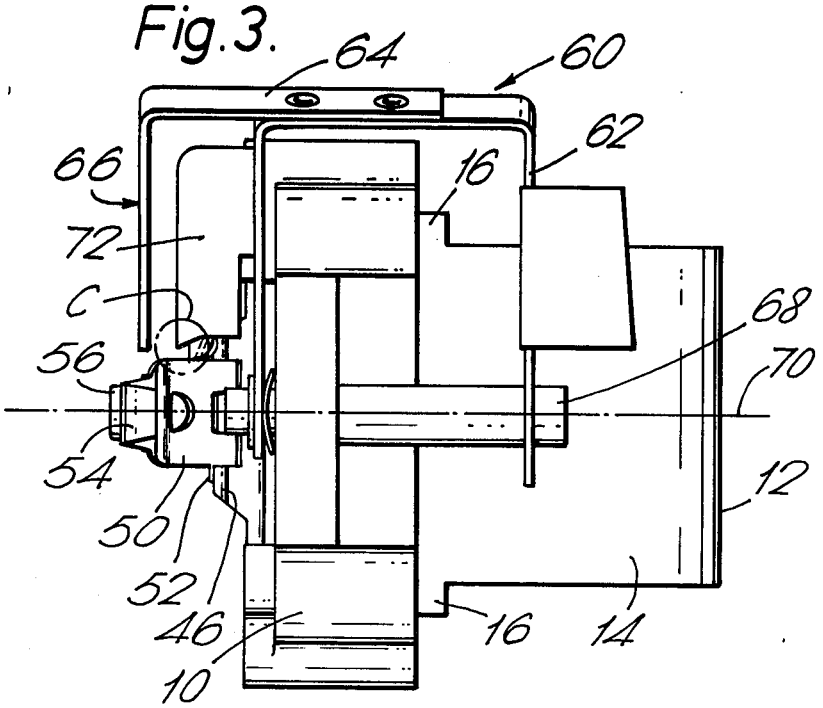
FIG. 3 is an end elevation on arrow 'B' in FIG. 1.

After hitting the stop 78, the flag assembly 60 falls back through its upper, non-indicating position as shown in full lines in FIG. 1 and towards a lower position in which the flag 66 is at an indicating position shown by a broken outline at 80 in FIG. 1. In the lower position 80 the flag 66 indicates that the device has been operated.

The flag assembly 60 can pass the upper, non-indicating position and fall to the lower, indicating position only if the coil 32 remains energised until the flag assembly 60 returns to the upper position and passes the interceptor member 76, which the attracted armature holds retracted out of the path of the plate 72. The period is set by adjustment of the stop 78 and is typically greater than 20 milliseconds (ms) and less than 50 ms. If the coil 32 is de-energised after a period less than 20 ms, the spring 54 returns the armature assembly 36 to the position shown in the drawings in which the interceptor member 76 is returned to its position in the path of the falling plate 72 and the fall of the flag assembly 60 is arrested at the upper non-indicating position shown in full in FIG. 1. The device thus discriminates between relatively shorter intervals and relatively longer intervals.

Typically, for example, the coil 32 of the device is connected to the secondary winding of a current transformer, the primary windings of which is formed by a three-phase electricity supply cable. During normal current supply, the three phases are in balance and no energisation of the coil 32 occurs. If a fault occurs, for example an earth fault (one or more phases-to-earth or phase-to-phase), it causes an imbalance in the currents of the phases, which may have a duration of greater than 20 ms, for example. Such a fault causes the coil 32 to be energised for a period sufficient to allow the flag 66 to fall to the lower indicating position 80. Typically, for example, a fault current of 30 to 34 amps would give rise to a coil-energising current of 0.4 amps.

However, the operation of circuit-breakers in the system can give rise to currents which only have a short duration, for example less than 20 ms. In these circumstances, the coil 32 de-energises and allows the interceptor member 76 to return to its support position thereby preventing the flag assembly 60 from dropping to the lower indicating position.

After the flag assembly 60 has fallen to the lowermost indicating position, the device must be re-set manually so that the flag 66 is once again in the non-indicating position shown in full lines in FIG. 1. The device may if preferred be housed in a case (not shown) having a window at which the flag 66 appears in its indicating position.

Although the application of the device just described caused the coil 32 to be energised by alternating current, direct current can be used to energise the coil 32 instead.

Modifications (not shown) are possible within the scope of the invention.

For example, the device could alternatively be used otherwise than as an indicator device. For example it may be used as a switch or relay device or as a control device or for combined purposes whether including indicating or not. For example, a bridging contact, on either the armature assembly 36 or the flag assembly 60, may be used to complete or break another circuit, which may constitute a relay or control function or may give a remote indication; or any such facilities may be combined. The flag 66 may be dispensed with or retained, as required.

The coil and armature arrangement described above can be replaced by a coil having an armature within the coil for movement on energisation of the coil, i.e. a solenoid arrangement. In other arrangements, the electromagnetic mechanism could be arranged so that an indication or other function is performed upon energisation of the mechanism instead of upon de-energisation as described above; or the electromagnetic mechanism could be arranged to be energised in a reverse sense to cause an indication to be given.

Other modifications (not shown) are also possible. For example, the interceptor member 76 need not be integral with the armature assembly; the member 76 could be cranked and mounted on its own pivot axis for movement by the armature, return movement being achieved by means of a spring, say. The cam surface could be provided on the interceptor member 76 instead of on the flag assembly 60. Movement of the interceptor member 76 could be linear instead of rotary.

Movement of the flag 66 could be linear also instead of rotary, the movement being imparted to the flag from the rotor through a suitable linkage. The flag may, in a modification (not shown), be provided on a part of the rotor at the opposite side of the pivot axis 70 from that shown so that flag movement to give a change of indication of operation is upward instead of downward. Also, the indication given by the device could be that it has not operated.

Movement of the rotor could be assisted by biasing means, such as a spiral spring, for example. The pivot axis 70 may be vertical in that case. In other arrangements, the pivot axis may be at some other angle or, as described above, horizontal, the biasing means assisting gravity.

The device, whatever its application, discriminates between relatively shorter intervals and relatively longer intervals producing a corresponding change in the position of the rotor and the device is usefully applicable in many applications whether indicating or otherwise as will be readily understood from the example and modifications described above.

What I claim is:

1. A discriminator device comprising a support structure, stop means mounted on said structure, means on said structure defining a pivot axis, a rotor mounted on said structure and angularly displaceable about said pivot axis to positions including first and second positions, said first position being intermediate said stop means and said second position, an electromagnetic mechanism mounted on said structure and an interceptor member carried by said structure and displaceable relatively thereto in first and second senses respectively towards and away from a station in which said interceptor member is normally engaged by said rotor in said first position, displacement of said interceptor member in said second sense propelling said rotor towards said stop means, an interval less than a predetermined value between a displacement of said interceptor member in said second sense and a displacement in said first sense allowing said interceptor member to return to said station early enough to intercept said rotor at said first position after said rotor has struck said stop means and in the return motion of said rotor therefrom, but a longer interval causing said interceptor member to be too late to intercept said rotor which continues in its return motion beyond said first position to reach said second position, and said mechanism being operable to displace said interceptor member in at least one of said first and second senses.

2. A device according to claim 1, in which said electromagnetic mechanism comprises a coil and an armature.

3. A device according to claim 2, in which said structure has second means defining a second pivot axis which is transverse to an axis about which said coil is wound, said armature being mounted on said structure for angular displacement about said second pivot axis.

4. A device according to claim 2, in which said interceptor member comprises an integral extension of said armature.

5. A device according to claim 1, in which said rotor has a cam surface which interacts with said interceptor member during movement of said interceptor member in said second sense.

6. A device according to any preceding claim, in which said rotor has flag means whereby a visual indication is available from said device.

* * * * *